US005797300A

United States Patent [19]

Fairbanks

[11] Patent Number: 5,797,300

[45] Date of Patent: Aug. 25, 1998

[54] COLLAPSIBLE RATCHETING SOCKET WRENCH

[76] Inventor: Jeffery N. Fairbanks, Rte. 2, Box 86-D, Mullins, S.C. 29574

[21] Appl. No.: 681,321

[22] Filed: Jul. 22, 1996

[51] Int. Cl.[6] ..... B25B 13/46; B25B 23/16; B25G 1/00

[52] U.S. Cl. ..... 81/60; 81/124.7; 81/177.8; 81/177.2; 81/177.6; 81/177.7

[58] Field of Search ..... 81/177.1–177.9, 81/58.1, 60, 124.3, 124.7

[56] References Cited

U.S. PATENT DOCUMENTS

| | | | |
|---|---|---|---|
| 501,811 | 7/1893 | Stombaugh . | |
| 598,003 | 1/1898 | Oliver . | |
| 666,202 | 1/1901 | Lord . | |
| 841,812 | 1/1907 | Pement . | |
| 1,180,982 | 4/1916 | Czesnak et al. . | |
| 1,193,725 | 8/1916 | Smith . | |
| 1,388,031 | 8/1921 | Dray . | |
| 1,643,855 | 9/1927 | Peterson | 81/177.75 |
| 1,791,185 | 2/1931 | Birkenmaier . | |
| 1,800,504 | 4/1931 | Chance . | |
| 2,465,152 | 3/1949 | Ellison | 81/177.5 X |
| 2,569,528 | 10/1951 | Kandle . | |
| 2,627,330 | 2/1953 | Gantz | 81/177.2 X |
| 2,697,370 | 12/1954 | Brooks | 81/177.85 X |
| 2,778,396 | 1/1957 | Swain | 81/177.6 X |
| 2,983,345 | 5/1961 | Langer . | |
| 3,848,367 | 11/1974 | Barnes . | |
| 4,449,559 | 5/1984 | Martinmaas . | |
| 4,542,667 | 9/1985 | Jang . | |
| 4,627,315 | 12/1986 | Lin . | |
| 4,733,583 | 3/1988 | Lewis | 81/177.7 X |
| 4,984,844 | 1/1991 | Tekeyan . | |
| 5,011,107 | 4/1991 | Reece . | |
| 5,224,310 | 7/1993 | Edwards et al. . | |
| 5,228,570 | 7/1993 | Robinson . | |
| 5,233,892 | 8/1993 | Roberts | 81/177.2 X |
| 5,263,391 | 11/1993 | Naylor . | |
| 5,392,672 | 2/1995 | Larson et al. . | |

FOREIGN PATENT DOCUMENTS

| | | | |
|---|---|---|---|
| 775431 | 10/1934 | France | 81/177.5 |
| 257869 | 3/1928 | Italy | 81/177.7 |

*Primary Examiner*—D. S. Meislin
*Attorney, Agent, or Firm*—Michael A. Mann

[57] ABSTRACT

The present invention is a collapsible ratcheting socket wrench having a ratcheting member and a first and second rod pivotally carried by the ratcheting member. Connected to the ratcheting member is an extension and a socket that are designed to engage a lug nut on a vehicle's tire. The first rod and second rod have a locked positioned, which is secured by a pair of sleeves that are slidably mounted on the rods. In the locked position a rotational force applied to the rods is transmitted as a torque to the socket and lug nut. The rods also have an attachment stub positioned on the ends of the rods distal from the ratcheting member that is designed to carry and hold the extension and socket when these two pieces are not in use. In addition, when the extension and socket are carried by the rods and the rods are in their collapsed position, the wrench presents a smaller, more compact profile, thus reducing the amount of space necessary to store the wrench.

20 Claims, 2 Drawing Sheets

COLLAPSIBLE RATCHETING SOCKET WRENCH

BACKGROUND OF THE INVENTION

1. Field of the Invention

The present invention relates to ratcheting socket wrenches. In particular, the present invention relates to a ratcheting socket wrench that is collapsible and is able to detachably carry a socket and an extension in a storage position.

2. Discussion of Background

Changing a tire on a vehicle can be both an unpleasant and difficult task. On a large number of vehicles the lug nuts, which secure the tires to the vehicle, are put on by an air wrench, and thus the amount of torque necessary to loosen the individual lug nuts is greater than some people are physically able to apply. When the tire on a vehicle goes flat, the tire must be changed then or risk damaging the rim. However, if the tire goes flat in a location away from an air wrench, the lug nuts must be removed manually, using a tire iron.

Tire irons typically come in two basic forms. The first is the type normally provided by the vehicle manufacture and has a single socket with a single bar extending therefrom. This type of tire iron is usually carried in the trunk of the vehicle, along with the jack and spare tire. The second type of tire iron is commonly known as a star iron and has four sockets arranged in a cross pattern. This type of tire iron is normally used only in garages and other vehicle repair facilities, as it takes up a relatively large amount of space in the trunk of a vehicle.

When changing a flat tire with either of these two tire irons, it is often the case that a full revolution of the tire iron is not possible because the lug nuts on the rim of the flat tire are too close to the ground. Thus, in these cases it is necessary to remove the tire iron and reposition it on the lug nut, which is both slow and tedious.

If the flat tire must be changed by the use of the single socket tire iron—for example, when the tire goes flat during a trip or when driving around town—it is often difficult to "break" or loosen the lug nut. As stated above, the air wrenches apply a greater amount of torque than is necessary to secure the lug nut to the vehicle; therefore to loosen the lug nut it is necessary to apply a force at least equal to the amount of force used to put it on. Additionally, because the lug nut may have been in place for a long period of time, exposed to dirt, grime, water, and other substances, the force required to loosen the lug nut may need to be even greater than the force used to put the lug nut on. However, the use of a single arm socket wrench only allows a person to apply a force to one side of the wrench, thus generating a torque from only one location. In some situations, many people stand or jump of the arm of the wrench in an effort to loosen the lug nuts, a method that can be both dangerous and damaging.

Therefore, there is a need for a socket wrench that allows a person to generate the necessary amount of torque to loosen the lug nuts yet occupy a relatively small space. In addition, this wrench should be able to be rotated without interfering with the ground, thus avoiding repeated removal and replacement of the socket on the lug nut.

SUMMARY OF THE INVENTION

According to its major aspects and broadly stated, the present invention is a collapsible ratcheting socket wrench for use with a lug nut on a tire or any other nut or bolt head. The wrench comprises a ratcheting member and a first and second rod. The ratcheting member has a mounting stub that is adapted to hold a socket and an extension, if needed. The first rod and second rod are pivotally carried by a pair of U-shaped brackets on the ratcheting member.

Slidably positioned on the first rod and the second rod are a first sleeve and a second sleeve, respectively. The first sleeve and second sleeve act in combination to lock first rod and second rod in an aligned position, so that first rod and second rod are collinear. When first rod and second rod are in the locked position and when the socket is positioned on the mounting stub, a person may turn the wrench by applying opposing forces to the two rods, thus applying a torque to the socket which is transmitted to the bolt or nut on which the socket is positioned.

Positioned at the end of the first rod is a first attachment stub, and at the end of the second rod is a second attachment stub. These attachment stubs are designed to hold or carry the socket and extension when they are not in use on the mounting stub. Thus, when the rods are unlocked and pivoted towards each other and when the socket and extension are positioned on the first rod and second rod, respectively, the wrench presents a smaller, more compact profile.

A major feature of the present invention is the ability of the rods to pivot into a position having a smaller profile. This feature, in combination with the first and second attachment stubs to carry and hold the socket and extension, provides a wrench that can be stored in a relatively small amount of space. Furthermore, the compactness of the wrench allows it to be carried and stored in the trunk of a vehicle without taking up unnecessary room. In fact, when folded, it may take up less room than a standard tire iron.

Another feature of the present invention is the ratcheting member. By having the ability to ratchet, the wrench can be positioned on the lug nut of a tire, turned, and then ratcheted back for another turn without having to remove the socket from the lug nut, which is especially important when there is an obstacle to full rotation of the wrench. This ability to ratchet not only facilitates the removal of the lug nut, but also reduces the amount of time needed to remove the lug nut. In addition, the ratcheting member has a switch that changes the direction in which torque is applied, thus allowing the wrench to be used to loosen or tighten the lug nut, depending on the direction of rotation.

Still another feature of the present invention are the first and second sleeves that are slidably mounted on the first and second rods, respectively. Each sleeve locks its rod, so that in combination the two rods are aligned and collinear. In this locked position, a force may be applied to a single rod, or both, so that a resultant torque is applied to either tighten or loosen the lug nut.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figures 1, 4:
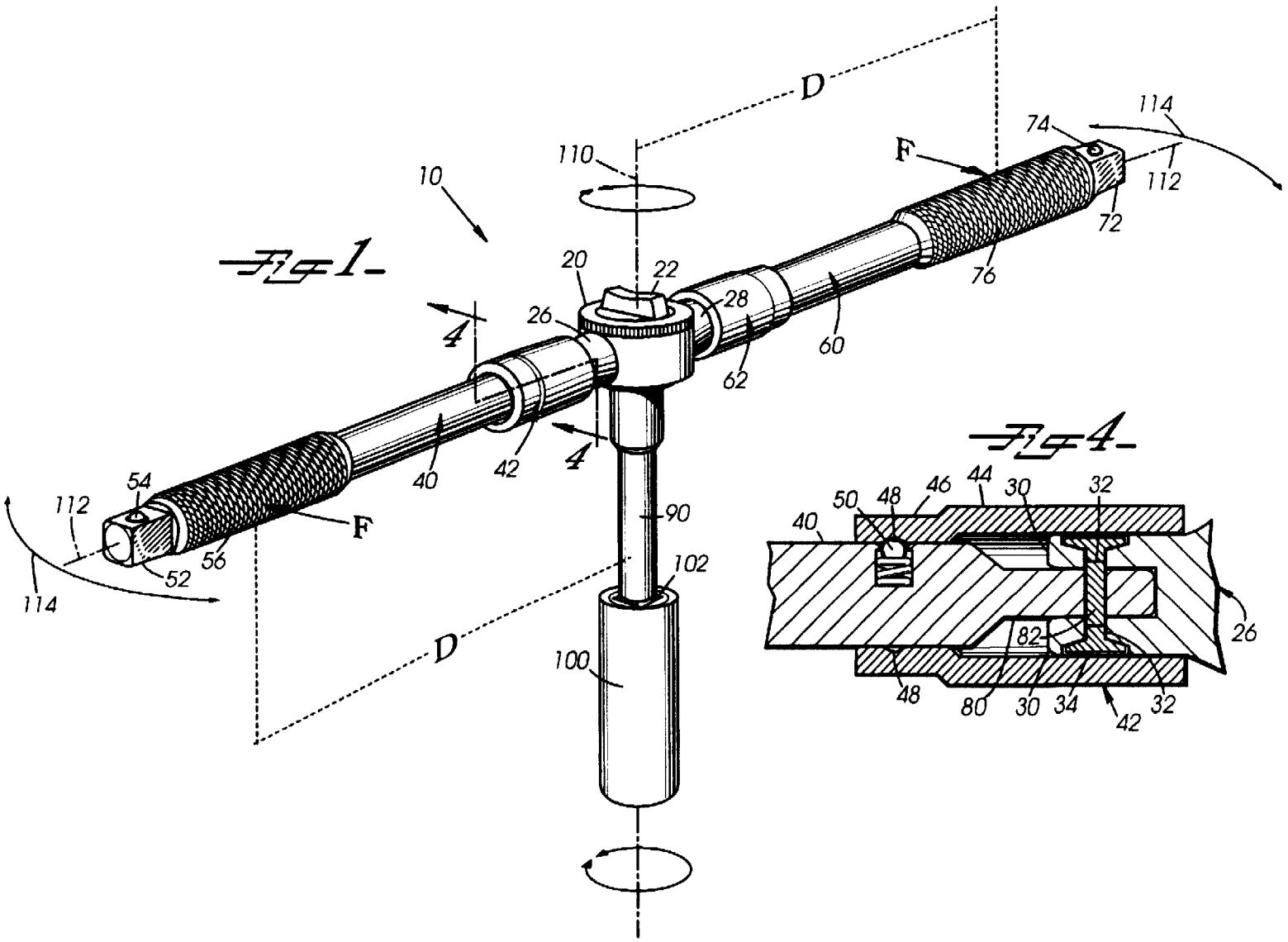
FIG. 1 is a perspective view of a collapsible ratcheting socket wrench, according to a preferred embodiment of the present invention.
FIG. 4 is a cross-sectional view of a collapsible ratcheting socket wrench taken along line 4—4 of FIG. 1, according to a preferred embodiment of the present invention.

Referring now to the figures, a collapsible ratcheting socket wrench is shown generally as numeral 10. Wrench 10 will be described, and in the preferred embodiment is dimensioned for use on a typical lug nut on a tire of a vehicle. However, it will be recognized that the present invention may be constructed and dimensioned for use on a variety of different sized nuts and bolts.

In the preferred embodiment, wrench 10 comprises a ratcheting member 20 and a first rod 40 and second rod 60. Ratcheting member 20, as is known to those of ordinary skill in the art, is a mechanical device that transmits intermittent rotary motion to a shaft, so that movement of the ratchet in one direction transmits this motion to the shaft, while movement in the opposite direction does not. Ratcheting member 20 also has a switch 22 positioned on its top that enables the ratcheting direction to be changed, so that ratcheting member 20 may be used to either loosen or tighten a lug nut.

Figure 2:
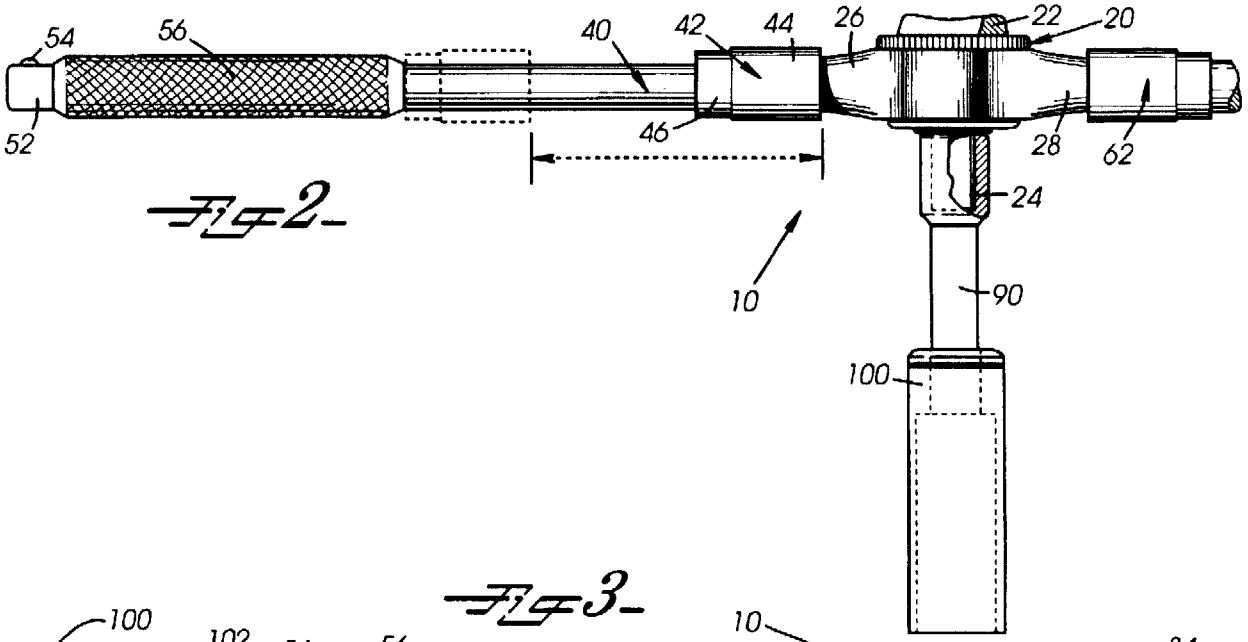
FIG. 2 is a partial side view of a collapsible ratcheting socket wrench, illustrating the movement of a sleeve, according to a preferred embodiment of the present invention.

A mounting stub 24, as shown in FIG. 2, is affixed on ratcheting member 20 and is dimensioned to be received within an extension 90. Mounting stub 24 has a rectangular cross-section with a spring-biased ball (not shown) for securely holding extension 90. Mounting stub 24 is received in a recess 92, shown in FIG. 3, within extension 90, and extension 90 has a stub 94 that is received within a recess 102 in a socket 100. Socket 100 is designed to fit over a lug nut, and if turned, to apply a torque to the lug nut. It will be noted that extension 90 is optional, and that socket 100 may be affixed to mounting stub 24.

Positioned at opposing hemispheres of ratcheting member 20 is a first bracket 26 and a second bracket 28. Both brackets 26, 28 are U-shaped with a pair of legs 30 extending therefrom. In addition, legs 30 have a hole 32 that extends therethrough.

First bracket 26 is designed to pivotally carry first rod 40, and second bracket 28 is design to pivotally carry second rod 60. FIG. 4 illustrates the connection of first rod 40 to first bracket 26. Second rod 60 is similarly connected to second bracket 28. First rod 40 has a flange 80, as shown in FIG. 4, with a hole 82 extending therethrough, which is positionable between legs 30 of first bracket 26. When first rod 40 is connected to first bracket 26, a pin 34 fits through holes 32 in legs 30 and flange 80, thus securing rod 40 to first bracket 26, while permitting it to pivot freely.

Slidably positioned over first rod 40 and second rod 60 are a first sleeve 42 and a second sleeve 62, respectively. Sleeves 42, 62 are substantially tubular and dimensioned to fit over rods 40, 60. However, the dimension's of sleeves 42, 62 should correspond to the structure of rods 40, 60, and thus the cross section of both rods 40, 60 and sleeves 42, 62 may be non-circular. For example, rods 40, 60 could have a substantially square cross-section, in which case sleeves 42, 62 would have a cross-section that permitted sleeves 42, 62 to slid along the length of rods 40, 60.

Only the operation of first rod 40, first bracket 26 and first sleeve 42 will be discussed in detail, as the operation of second rod 60, second bracket 28, and second sleeve 62 would be substantially identical. As seen in FIG. 2, first sleeve 40 can be moved from a first position, distal to ratcheting member 20, to a locked position, proximate to ratcheting member 20. In the preferred embodiment, first sleeve 42 is tubular, having a first portion 44 and a second portion 46. The diameter of first portion 44 should be dimensioned so that first portion 44 will fit over first bracket 26, while second portion 46 is dimensioned to fit only over first rod 40, as shown in FIG. 1, and more specifically, in FIG. 4. In this locked position, first rod 40 is not able to pivot, and thus any force applied to first rod 40 is transmitted to ratcheting member 20. When both first rod 40 and second rod 60 are in the locked position, as shown in FIG. 1, first rod 40 is aligned with second rod 60 so that they are collinear.

First sleeve 42 and second sleeve 62 have a groove 48 positioned along the interior of first portion 44. When sleeves 42, 62 are in the locked position, groove 48, as shown in FIG. 4, is designed to engage a spring-biased ball 50, 70, thus securing sleeves 42, 62 in the locked position. It will be recognized that additional types of securing devices other than spring-biased ball 50 may be used to secure sleeves 42, 62 in the locked position.

Figure 3:
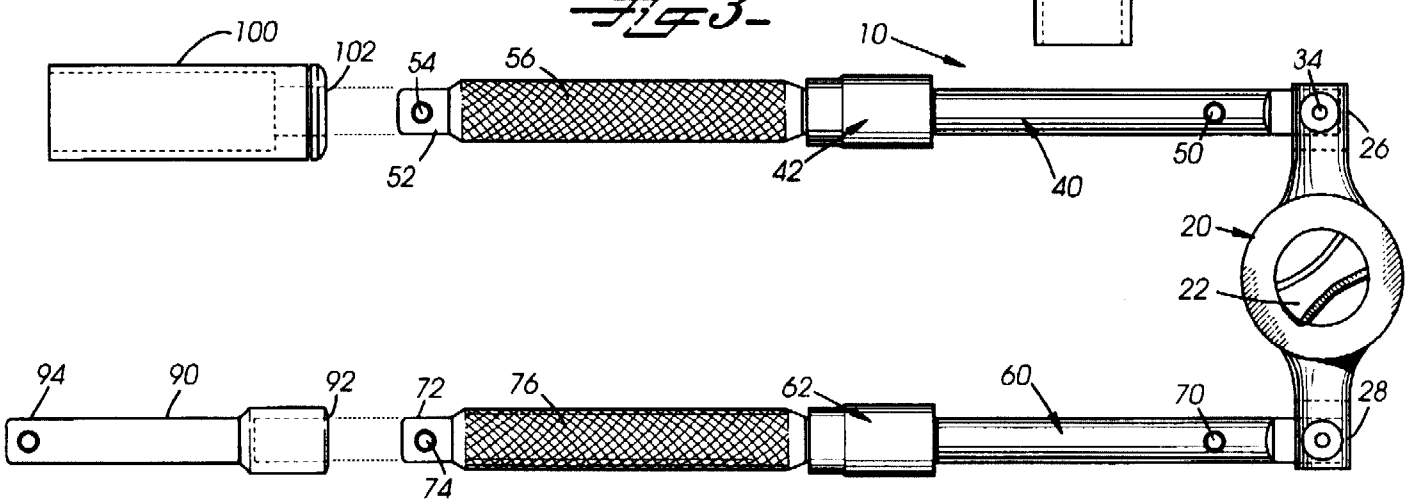
FIG. 3 is a top view of a collapsible ratcheting socket wrench, shown in the collapsed position with the socket and extension shown, according to a preferred embodiment of the present invention.

At the ends of first rod 40 and second rod 60, distal to ratcheting member 20, are attachment stubs 52, 72 which have spring-biased balls 54, 74 and are designed and dimensioned similar to mounting stub 24 on ratcheting member 20. Attachment stubs 52, 72 are designed to carry and hold extension 90 and socket 100 when these two are not in use or positioned on mounting stub 24. In other words, attachment stubs 52, 72 are received within recesses 92, 102 in either extension 90 or socket 100. When wrench 10 is in its collapsed position, as shown in FIG. 3, and extension 90 and socket 100 are positioned on attachment stubs 52, 72, wrench 10 and its accessories present a smaller, more compact profile than if first rod 40 and second rod 60 were in a fixed position.

Additionally, in the preferred embodiment, first rod 40 and second rod 60 have grips 56, 76 that are proximate to attachment stubs 52, 72. Grips 56, 76 are a portion of rods 40, 60 that have a varied texture or knurled surface, preferably of larger diameter than rods 40, 60, so that when a person applies a force to rods 40, 60, the likelihood of the person's hand slipping from grips 56, 76 is reduced. Furthermore, grips 56, 76 prevent first sleeve 42 and second sleeve 62 from sliding off of first rod 40 and second rod 60, respectively.

In operation, when first rod 40 and second rod 60 are in their locked position, as seen in FIG. 1, rods 40, 60 may be rotated, thus applying a torque to socket 100 and the lug nut. The rotation of socket 100 and extension 90 is about a rotational axis 110, such that rotational axis 110 and the line 112, defined by the collinear alignment of first rod 40 and second rod 60, define a first plane. In addition, the pivoting of first rod 40 and second rod 60 is designed so that, as shown by movement arrow 114, first rod 40 and second rod 60 pivot in a second plane that is perpendicular to the first plane.

By having grips 56, 76 positioned on both first rod 40 and second rod 60, a force applied by a person to wrench 10 is transmitted as torque applied to socket 100 and the lug nut. The torque that is applied to the lug nut is proportional to the amount of force applied to first rod 40 and second rod 60, and is proportional to the distance this force is applied away from rotational axis 110. In other words, as shown in FIG.

1, if a person applied equal forces F to first rod 40 and second rod 60, each at an equal distance D from rotational axis 110, the amount of torque generated by the person would be 2*Force*Distance or

2FD.

Therefore, if there is a fixed amount of torque that needs to be applied to a lug nut to loosen it, the amount of force F that must be applied by a person would in effect be halved. Thus, instead of applying the total required force at a given distance, the person would be required to apply only half of the force F to each first rod 40 and second rod 60, thus generating the required amount of torque. Even though a person is in effect applying the same amount of force, just to two separate positions, it is easier for a person to gain leverage by both pushing and pulling to apply the required force, than it is by only pushing or only pulling.

It will be apparent to those skilled in the art that many changes and substitutions can be made to the preferred embodiment herein described without departing from the spirit and scope of the present invention as defined by the appended claims.

What is claimed is:

1. A wrench comprising:

a ratcheting member;

a first rod pivotally carried by said ratcheting member;

a second rod pivotally carried by said ratcheting member; and means for locking said first rod and said second rod in a locked position with respect to said ratcheting member, so that said first rod and said second, rod are in a non-pivotal position, said ratcheting member having a mounting stub, said mounting stub having an axis of rotation; and wherein when said first rod and said second rod are in said locked position, said first rod, said second rod, and said rotational axis of said mounting stub define a first plane, so that said first rod and said second rod pivot in a second plane perpendicular to said first plane.

2. The wrench as recited in claim 1, wherein said first rod and said second rod are aligned and collinear when said first rod and said second rod are in said locked position.

3. The wrench as recited in claim 1, wherein said locking means further comprises:

a first sleeve slidably mounted on said first rod;

a second sleeve slidably mounted on said second rod;

first means for securing said first sleeve in a locked position; and second means for securing said second sleeve in a locked position.

4. The wrench as recited in claim 1, wherein said ratcheting member further comprises:

a first U-shaped bracket, said first rod having a first flange dimensioned to pivotally fit within said first U-shaped bracket; and a second U-shaped bracket, said second rod having a first flange dimensioned to pivotally fit within said second U-shaped bracket.

5. The wrench as recited in claim 1, further comprising an extension adapted to be mounted to said ratcheting member and a socket adapted to be mounted on said extension.

6. The wrench as recited in claim 2, wherein said locking means further comprises:

a first sleeve slidably mounted on said first rod;

a second sleeve slidably mounted on said second rod;

first means for securing said first sleeve in a locked position; and second means for securing said second sleeve in a locked position.

7. The wrench as recited in claim 2, wherein said ratcheting member further comprises:

a first U-shaped bracket, said first rod having a first flange dimensioned to pivotally fit within said first U-shaped bracket; and a second U-shaped bracket, said second rod having a first flange dimensioned to pivotally fit within said second U-shaped bracket.

8. The wrench as recited in claim 2, further comprising an extension adapted to be mounted to said ratcheting member and a socket adapted to be mounted on said extension.

9. The wrench as recited in claim 3, wherein said ratcheting member further comprises:

a first U-shaped bracket, said first rod having a first flange dimensioned to pivotally fit within said first U-shaped bracket; and a second U-shaped bracket, said second rod having a first flange dimensioned to pivotally fit within said second U-shaped bracket.

10. A wrench for turning a lug nut, said wrench comprising:

a ratcheting member;

a socket that is removably carried by said ratcheting member;

a first rod pivotally carried by said ratcheting member;

a second rod pivotally carried by said ratcheting member;

means for locking said first rod and said second rod in a locked position with respect to said ratcheting member, so that said first rod and said second rod are in a non-pivotal position and aligned; and means carried by said first rod for removably carrying said socket, said ratcheting member having a mounting stub, said mounting stub having an axis of rotation; and wherein when said first rod and said second rod are aligned, said first rod, said second rod, and said rotational axis of said mounting stub define a first plane, and wherein said first rod and said second rod pivot in a second plane perpendicular to said first plane.

11. The wrench as recited in claim 10, wherein said carrying means further comprises an attachment stub on said first rod, said attachment stub having a spring-biased ball, said spring-biased ball further securing said socket to said attachment stub.

12. The wrench as recited in claim 10, wherein said carrying means further comprises an attachment stub on said first rod.

13. The wrench as recited in claim 10, wherein said carrying means further comprises an attachment stub on said first rod, said attachment stub having a spring-biased ball, said spring-biased ball further securing said socket to said attachment stub; and wherein said wrench further comprises:

an extension; and a second attachment stub carried by said second rod, said second attachment stub dimensioned to hold said extension, and said second attachment stub having a second spring-biased ball for further securing said extension to said second rod.

14. The wrench as recited in claim 10, wherein said locking means further comprises a first sleeve carried by said first rod and a second sleeve carried by said second rod.

15. The wrench as recited in claim 10, wherein said ratcheting member has a direction of rotation and a switch for alternating said direction of rotation.

16. A wrench comprising:

a ratcheting member having mounting stub;

a socket that is removably carried by said mounting stub;

a first rod pivotally carried by said ratcheting member;

a second rod pivotally carried by said ratcheting member;

a first sleeve slidably mounted on said first rod, said first sleeve having a locked position, said first sleeve locking said first rod in a non-pivotal position when said first sleeve is in said locked position;

a second sleeve slidably mounted on said second rod, said second sleeve having a locked position, said second sleeve locking said second rod in a non-pivotal position when said second sleeve is in said locked position; and means carried by said first rod for removably carrying said socket, wherein said mounting stub of said ratcheting member has an axis of rotation, and wherein when said first rod and said second rod are in said non-pivotal positions, said first rod, said second rod and said rotational axis of said mounting stub define a first plane, and wherein said first rod and said second rod pivot in a second plane perpendicular to said first plane.

17. The wrench as recited in claim 16, wherein when said first rod is in said locked position and said second rod is in said locked position, said first rod and said second rod are aligned and collinear.

18. The wrench as recited in claim 16, wherein said first rod has a first spring-biased ball, and said second rod has a second spring-biased ball, said first spring-biased ball locking said first sleeve in said locked position, and said second spring-biased ball locking said second sleeve in said locked position.

19. The wrench as recited in claim 16, wherein said first rod and said second rod have a grip means.

20. The wrench as recited in claim 16, wherein said carrying means further comprises a first attachment stub adapted to removably carry said socket; and wherein said wrench further comprises an extension, and a second attachment stub on said second rod adapted to removably carry said extension.

* * * * *